US005283929A

United States Patent [19]

Lin

[11] Patent Number: 5,283,929

[45] Date of Patent: Feb. 8, 1994

[54] HINGE

[76] Inventor: Tsong-Chi Lin, No. 146, Min Chuan Road, Dar Hu Village, Hu-Nei Shiang, Kaohsiung Hsien, Taiwan

[21] Appl. No.: 891,060

[22] Filed: Jun. 1, 1992

[51] Int. Cl.[5] ..... E05D 7/04

[52] U.S. Cl. ..... 16/237

[58] Field of Search ..... 16/236, 237, 238, 249, 16/DIG. 43, 235, 247

[56] References Cited

U.S. PATENT DOCUMENTS

| | | | |
|---|---|---|---|
| 3,952,364 | 4/1976 | Lautenschlaeger | 16/DIG. 43 |
| 4,045,841 | 9/1977 | Rock et al. | 16/238 |
| 4,604,769 | 8/1986 | Rock et al. | 16/238 |
| 4,776,061 | 10/1988 | Franco | 16/236 |
| 4,819,298 | 4/1989 | Lautenschlager | 16/347 |
| 4,987,640 | 1/1991 | Lin | 16/327 |

FOREIGN PATENT DOCUMENTS

| | | | |
|---|---|---|---|
| 2601809 | 7/1977 | Fed. Rep. of Germany | 16/237 |
| 1587901 | 4/1981 | United Kingdom | 16/237 |

OTHER PUBLICATIONS

U.K. Patent Application No. 2,178,791A; pub. Feb. 18, 1987 Inventor: Franco Ferrari.

*Primary Examiner*—Lowell A. Larson
*Assistant Examiner*—Donald M. Gurley
*Attorney, Agent, or Firm*—Jacobson, Price, Holman & Stern

[57] ABSTRACT

A hinge having a mounting plate (2) being fixed on a side wall of a piece of furniture, a base (1) being fixed on a door of a piece of furniture, and a hinge arm (3) being pivotally combined with the base (1) and able to be adjusted relatively in the vertical and a horizontal direction in relation to the mounting plate (2).

4 Claims, 1 Drawing Sheet

HINGE

BACKGROUND OF THE INVENTION

A known hinge patented in U.S. Pat. No. 4,987,640 titled "Super-thin Hinge With Resiliently Biased Catch" by the same applicant of this application has a mounting plate 2 to be fixed on a side wall of a piece of furniture, a hinge arm 3 to be combined with the mounting plate 2 and a base 1 to be fixed on a door of a piece of furniture. To fix the base 1 on the door, holes have to be bored in the door beforehand, and positions of the holes bored may often be a little incorrect which causes inconvenience in fixing the base on the door. In consequence, the hinge arm 3 and the mounting plate 2 should be adjusted in correlative position.

SUMMARY OF THE INVENTION

The object of this invention is to improve the hinge patented in U.S. Pat. No. 4,987,640 to add an adjustable structure for the hinge arm 3 and the mounting plate 2 so as to compensate for an incorrect position of the base 1 after it is fixed on a door of a piece of furniture.

The hinge in the present invention has a hinge arm, one end of which is pivotally combined with a base by means of a pivot pin to allow the hinge arm to swing to and fro. The hinge arm, has a lengthwise slot opening to the other end of the hinge arm for a bolt to pass through to screw with a threaded hole in the mounting plate, two parallel walls defining the slot, and two lines of saw teeth on the bottom surfaces of the two parallel walls. The mounting plate has rectangular projection fitting in a hollow space between the two parallel walls and two racks on both side surfaces adjacent the projection to engage the two lines of saw teeth in the hinge arm so that the base can be adjusted in the vertical and the horizontal direction in relation to the mounting plate.

BRIEF DESCRIPTION OF DRAWINGS

This invention will now be described in detail with reference to accompanying drawings wherein.

DETAILED DESCRIPTION OF THE INVENTION

Figure 1:
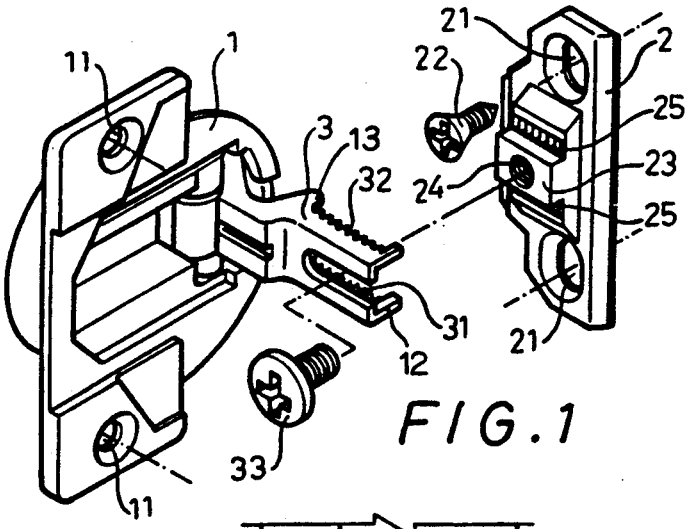
FIG. 1 is an exploded perspective view of the hinge of the present invention.

The hinge in accordance with the present invention, as shown in FIG. 1, comprises a base 1, and a hinge arm 3 which is pivotally combined with the base 1 by a pivot pin to swing to and fro similar to the hinge arm of a conventional hinge. The base 1 is fixed firmly on a door of a piece of furniture. But the hinge arm 3 in the present invention has a lengthwise slot 31 provided substantially in the middle portion thereof opening at a free or distal end for a bolt 33 to pass through. The slot 31 is defined by two parallel walls and the slot 31 has a width a little larger than the diameter of the bolt 33. Two lines of saw teeth 32 are provided at the bottom surfaces of the two walls defining the slot 31 and a pair of projections (i.e. locating lugs) 12 and 13 respectively at each end of each line of saw teeth 32 able to abut the side walls of the projection 23 so as to locate the slot 31 in horizontal alignment with the hole 24.

The hinge in the present invention also comprises a mounting plate 2 having two screw holes 21 for two screws (i.e. fixing members) 22 to pass through to fix it on a side wall of a piece of furniture. The screw holes 21 are oval, allowing the mounting plate 2 be slightly adjusted vertically when fixing it on the side wall. The mounting plate 2 has a projection 23 in the middle portion between the screw holes 21, and a threaded hole 24 in the projection 23 for the bolt 33 to screw with. The width of the projection 23 is narrower than the distance between the two walls defining the slot 31, and two racks 25 each having a line of notched are provided on both parallel surfaces beside the projection 23. The lengths of the projection 23 and the racks 25 are shorter than that of the saw teeth 32.

Figure 2:
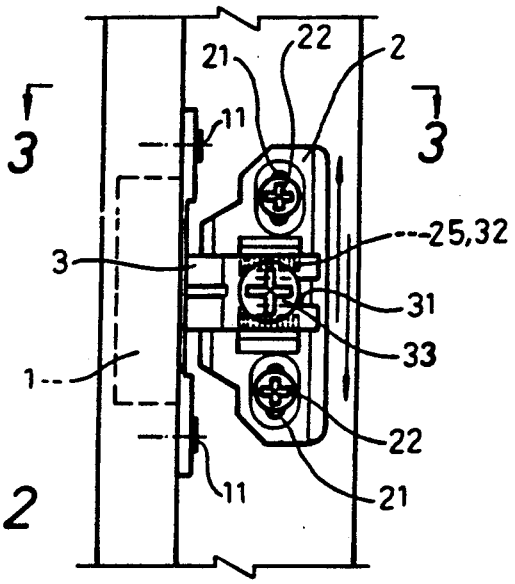
FIG. 2 is a partial front view of the hinge fixed on a piece of furniture.
Figure 3:
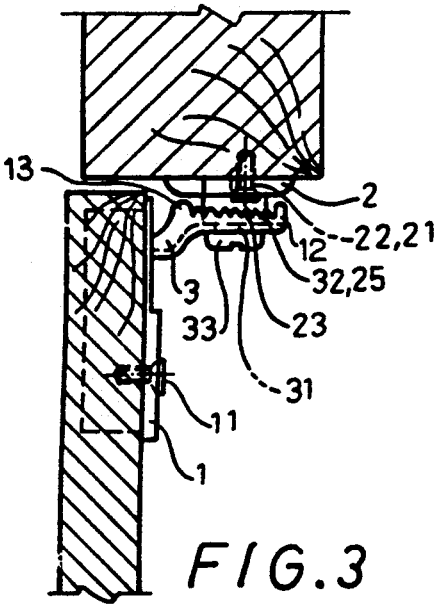
FIG. 3 is a cross-sectional view taken along line 3—3 of FIG. 2.
Figure 4:
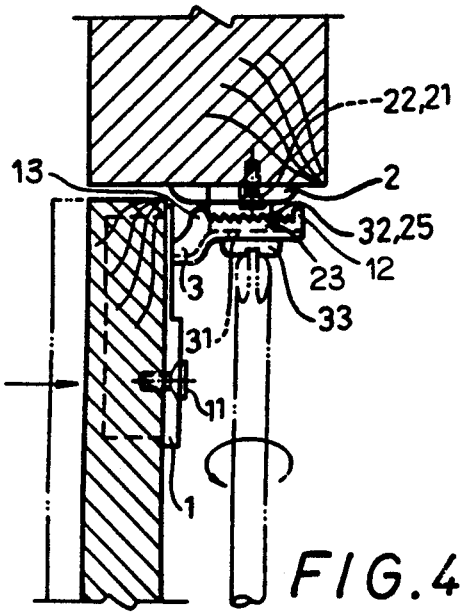
FIG. 4 is an operational view of FIG. 3.

FIG. 2 shows that the mounting plate 2 can be adjusted in its location on a side wall of a piece of furniture by moving it vertically when this hinge is to be mounted on the piece of furniture. FIG. 3 shows that the slot 31 in the hinge arm 3 can be moved in relation to the projection 23 on the mounting plate 2 to adjust the surface gap of the door and the adjacent surface when the door is closed.

The base 1 and the mounting plate 2 can be properly adjusted in a vertical direction and in a horizontal direction by loosening the bolt 33 for obtaining a proper gap between the door and the side wall of a piece of furniture.

What is claimed is:

1. A hinge for pivotally connecting a door and a side wall adjacent thereto comprising:

a) a hinge arm pivotally combined at one end thereof to a base, a lengthwise slot provided substantially in a middle portion of the hinge arm, said slot defined by a pair of substantially parallel walls and opening to a distal end of said hinge arm, a line of saw teeth on a bottom surface of each said parallel wall;

b) a mounting plate having oval holes therein for receiving fixing members, said oval holes allowing for vertical adjustment of the mounting plate relative to a surface to which said mounting plate is attached;

c) a substantially rectangular projection on said mounting plate having a hole therein and a pair of parallel racks on either side thereof, each said rack having a line of notches which are engaged with said saw teeth;

d) a locating lug extending substantially perpendicularly from the bottom surface at each end of each line of saw teeth able to abut the projection and the racks so as to locate said slot in substantially horizontal alignment with the hole in said substantially rectangular projection, e) each said line of saw teeth being longer than each said line of notches so that said hinge arm is relatively horizontally adjustable in relation to said mounting plate, and f) a fixing member passing through the lengthwise slot and into the hole in said projection.

2. The hinge of claim 1 wherein said fixing member comprises a screw or bolt and the hole in said projection comprises a threaded hole.

3. The hinge of claim 1 wherein said base is attached to the door of an article of furniture and the mounting plate is secured to the side wall of the furniture.

4. The hinge of claim 3 including screws or bolts which pass through said oval holes thereby attaching said mounting plate to said side wall.

* * * * *